US006058612A

United States Patent [19]

Leyva

[11] Patent Number: 6,058,612

[45] Date of Patent: May 9, 2000

[54] POWER TOOL MOUNTED POWER OUTLET

[76] Inventor: Robert M. Leyva, 8411 Velvet Cir., Huntington Beach, Calif. 92646

[21] Appl. No.: 09/130,094

[22] Filed: Aug. 6, 1998

[51] Int. Cl.[7] ..... B23D 45/16

[52] U.S. Cl. ..... 30/388; 30/390; 439/478

[58] Field of Search ..... 30/388–391, 500; 439/476.1, 478, 540.1

[56] References Cited

U.S. PATENT DOCUMENTS 2,534,875 12/1950 Miller ..... 439/478

2,795,248 6/1957 Doerner ..... 30/391

*Primary Examiner*—Douglas D. Watts

[57] ABSTRACT

A power tool is provided including a motor for operating upon the actuation thereof. An elongated power cord has a first end with a plug mounted thereon for releasably connecting with a power receptacle and a second end coupled to the power tool. At least one outlet is mounted on the power tool and connected to the power cord for supplying power to a plug that is releasably inserted within the outlet.

2 Claims, 3 Drawing Sheets

POWER TOOL MOUNTED POWER OUTLET

BACKGROUND OF THE INVENTION

1. Field of the Invention

The present invention relates to power tools and more particularly pertains to a new power tool mounted power outlet for providing a plurality of outlets on a portable power tool such as a saw.

2. Description of the Prior Art

The use of power tools is known in the prior art. More specifically, power tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art power tools include U.S. Pat. No. 5,278,740; U.S. Pat. No. 5,369,559; U.S. Pat. No. 4,019,047; U.S. Pat. No. 5,219,446; U.S. Pat. No. 4,520,239; and U.S. Pat. No. Des. 345,171.

In these respects, the power tool mounted power outlet according to the present invention substantially departs from the conventional concepts and designs of the prior art, and in so doing provides an apparatus primarily developed for the purpose of providing a plurality of outlets on a power tool such as a saw.

SUMMARY OF THE INVENTION

In view of the foregoing disadvantages inherent in the known types of power tools now present in the prior art, the present invention provides a new power tool mounted power outlet construction wherein the same can be utilized for providing a plurality of outlets on a power tool such as a saw.

The general purpose of the present invention, which will be described subsequently in greater detail, is to provide a new power tool mounted power outlet apparatus and method which has many of the advantages of the power tools mentioned heretofore and many novel features that result in a new power tool mounted power outlet which is not anticipated, rendered obvious, suggested, or even implied by any of the prior art power tools, either alone or in any combination thereof.

To attain this, the present invention generally comprises a power saw unit having a main assembly. Such main assembly is equipped with a generally dome-shaped housing having a circular saw mounted thereon and depending downwardly therefrom. The circular saw is adapted for rotating upon the receipt of power by an associated motor. The power saw unit further includes a handle having an arcuate configuration. A top end of the handle is connected to an apex of the housing. A lower end of the handle is connected to a lower portion of the housing. As such, the handle remains in a generally coplanar relationship with the circular saw. For selectively allowing the supply of power to the motor, a trigger is mounted on a lower face of the handle adjacent to the top end thereof. Next provided is an outlet housing integrally mounted between the bottom end of the handle and the lower portion of the housing of the power saw unit. The outlet housing has a rectangular configuration with a top face integrally coupled to the bottom end of the handle, a bottom face, an inboard face integrally coupled to the lower portion of the housing, an outboard face, and a pair of side faces. Also included is an elongated power cord with a length of at least 100 feet. The power cord is equipped with a first end with a plug mounted thereon for releasably connecting with a power receptacle. The power cord further has a second end coupled to the outboard face of the outlet housing via a grommet. The second end of the power cord is further in electrical communication with the motor of the power saw unit with the trigger connected therebetween. Mounted on a first one of the side faces of the outlet housing is a first outlet. The first outlet is connected to the power cord for supplying power to a plug that is releasably inserted within the first outlet. As shown in FIG. 2, the first outlet has a pair of parallel, vertically oriented rectangular slots and a generally circular ground aperture formed therebeneath. Associated therewith is a second outlet mounted on a second one of the side faces of the outlet housing. The second outlet is connected to the power cord for supplying power to a plug that is releasably inserted within the second outlet. The second outlet has three equally spaced arcuate slots which are positioned in a generally circular configuration each with an inwardly extending portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new power tool mounted power outlet apparatus and method which has many of the advantages of the power tools mentioned heretofore and many novel features that result in a new power tool mounted power outlet which is not anticipated, rendered obvious, suggested, or even implied by any of the prior art power tools, either alone or in any combination thereof.

It is another object of the present invention to provide a new power tool mounted power outlet which may be easily and efficiently manufactured and marketed.

It is a further object of the present invention to provide a new power tool mounted power outlet which is of a durable and reliable construction.

An even further object of the present invention is to provide a new power tool mounted power outlet which is susceptible of a low cost of manufacture with regard to both materials and labor, and which accordingly is then susceptible of low prices of sale to the consuming public, thereby making such power tool mounted power outlet economically available to the buying public.

Still yet another object of the present invention is to provide a new power tool mounted power outlet which provides in the apparatuses and methods of the prior art some of the advantages thereof, while simultaneously overcoming some of the disadvantages normally associated therewith.

Still another object of the present invention is to provide a new power tool mounted power outlet for providing a plurality of outlets on a power tool such as a saw.

Even still another object of the present invention is to provide a new power tool mounted power outlet that includes a motor for operating upon the actuation thereof. An elongated power cord has a first end with a plug mounted thereon for releasably connecting with a power receptacle and a second end coupled to the power tool. At least one outlet is mounted on the power tool and connected to the power cord for supplying power to a plug that is releasably inserted within the outlet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
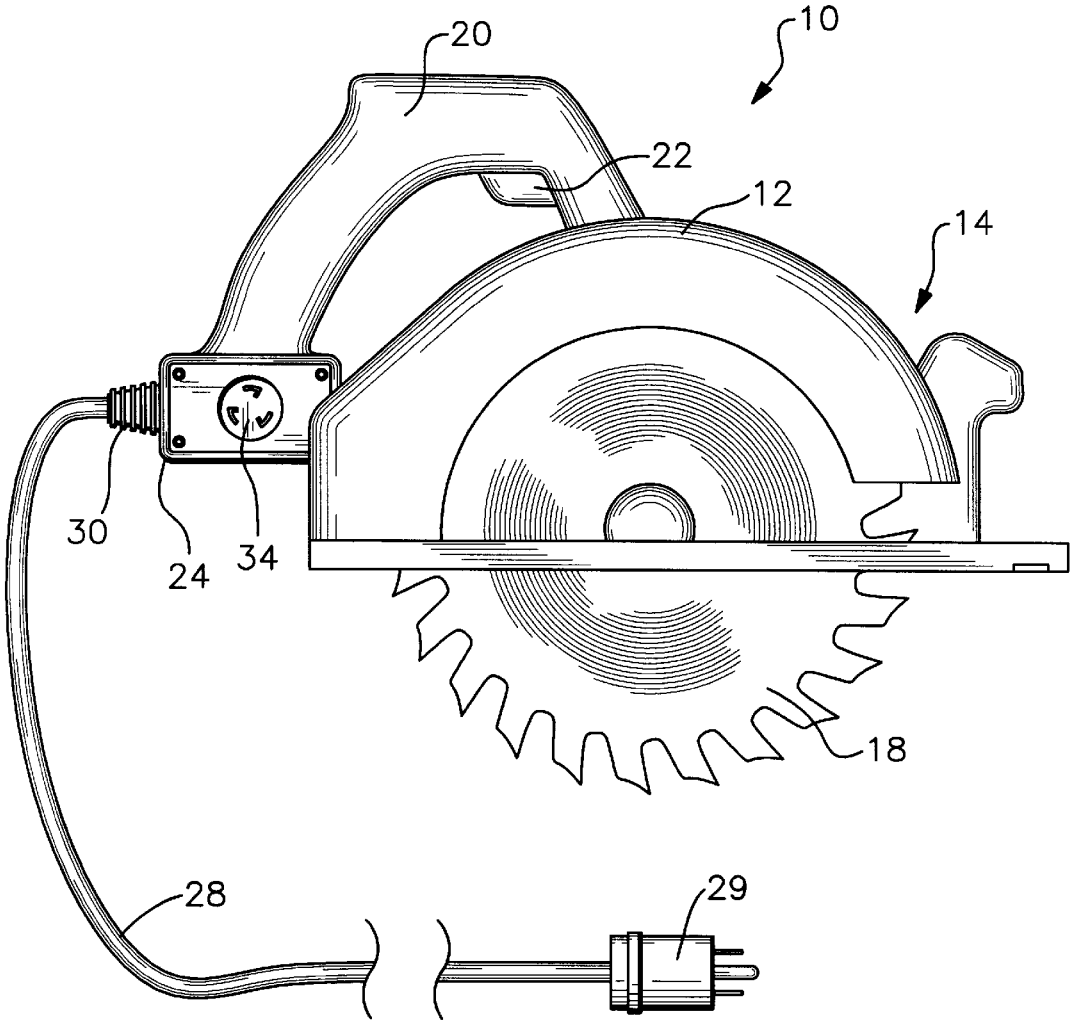
FIG. 1 is a side view of a new power tool mounted power outlet according to the present invention.
Figure 2:
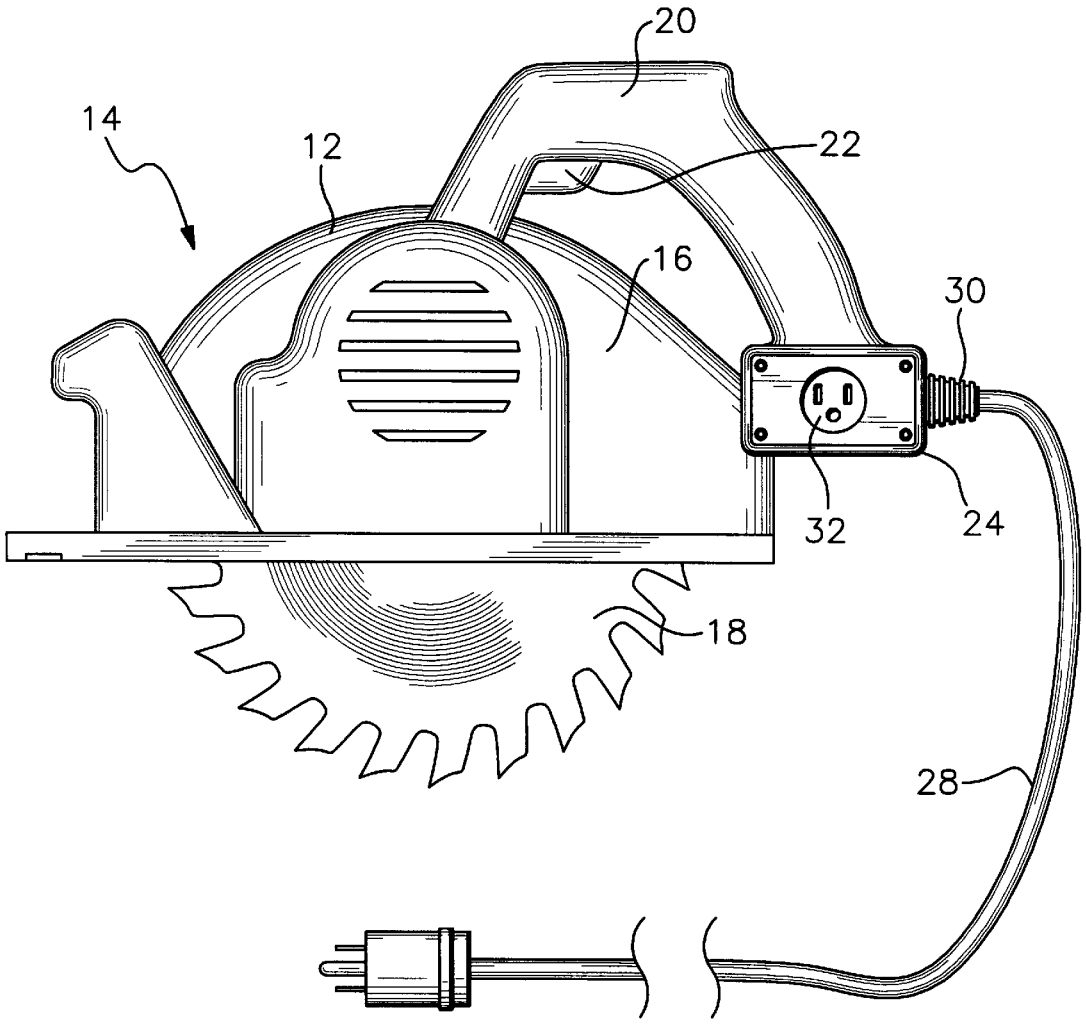
FIG. 2 is another side view of the present invention.
Figure 3:
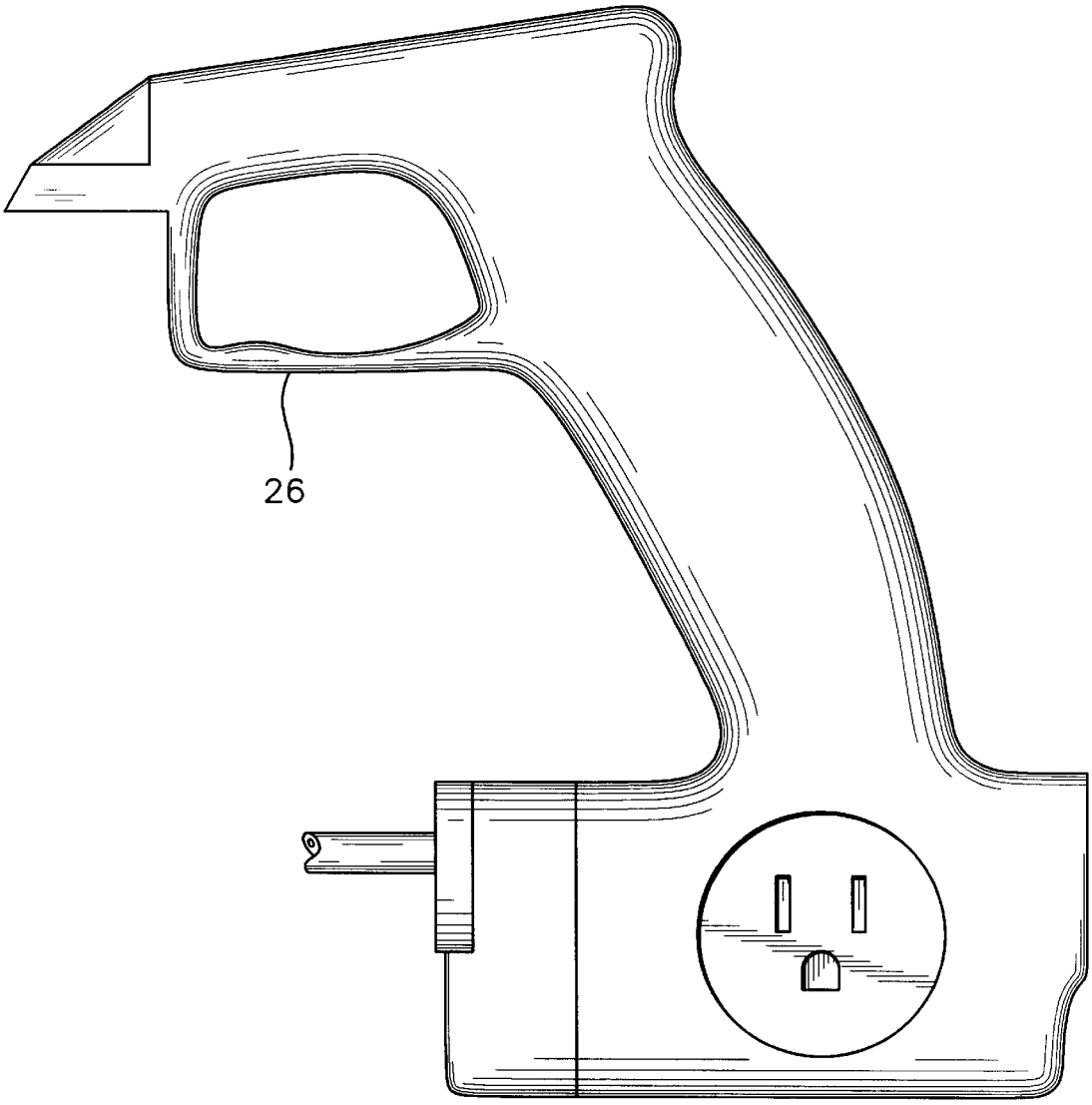
FIG. 3 is a side view of an alternate embodiment of the present invention.

With reference now to the drawings, and in particular to FIGS. 1 through 3 thereof, a new power tool mounted power outlet embodying the principles and concepts of the present invention and generally designated by the reference numeral 10 will be described.

The present invention, designated as numeral 10, includes a power saw unit 12 having a main assembly 14. Such main assembly is equipped with a generally dome-shaped housing 16 having a circular saw 18 mounted thereon and depending downwardly therefrom. The circular saw is adapted for rotating upon the receipt of power by an associated motor.

The power saw unit further includes a handle 20 having an arcuate configuration. A top end of the handle is connected to an apex of the housing. A lower end of the handle is connected to a lower portion of the housing. As such, the handle remains in a generally coplanar relationship with the circular saw. For selectively allowing the supply of power to the motor, a trigger 22 is mounted on a lower face of the handle adjacent to the top end thereof.

Next provided is an outlet housing integrally mounted between the bottom end of the handle 24 and the lower portion of the housing of the power saw unit. The outlet housing has a rectangular configuration with a top face integrally coupled to the bottom end of the handle, a bottom face, an inboard face integrally coupled to the lower portion of the housing, an outboard face, and a pair of side faces.

As shown in FIG. 3, the handle may include a guard member 26 encompassing the trigger. It should be noted that the handle of the present invention may further be a component of a power drill or the like.

Also included is an elongated power cord 28 with a length of at least 100 feet. The power cord is equipped with a first end having a plug 29 mounted thereon for releasably connecting with a power receptacle. The power cord further has a second end coupled to the outboard face of the outlet housing via a grommet 30. The second end of the power cord is further in electrical communication with the motor of the power saw unit with the trigger connected therebetween.

Mounted on a first one of the side faces of the outlet housing is a first outlet 32. The first outlet is connected to the power cord for supplying power to a plug that is releasably inserted within the first outlet. As shown in FIG. 2, the first outlet has a pair of parallel, vertically oriented rectangular slots and a generally circular ground aperture formed therebeneath.

Associated therewith is a second outlet 34 mounted on a second one of the side faces of the outlet housing. The second outlet is connected to the power cord for supplying power to a plug that is releasably inserted within the second outlet. The second outlet has three equally spaced arcuate slots which are positioned in a generally circular configuration each with an inwardly extending portion. The present invention is thus adapted to releasably receive various types of plugs of any one of a plurality of appliances or tools.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A saw with outlet comprising, in combination:

a power saw unit including a main assembly with a generally dome-shaped housing having a circular saw mounted thereon and depending downwardly therefrom for rotating upon the receipt of power by an associated motor, the power saw unit further including a handle having an arcuate configuration, a top end connected to an apex of the housing and a lower end connected to a lower portion of the housing such that the handle remains in a generally coplanar relationship with the circular saw, wherein a trigger is mounted on a lower face of the handle adjacent to the top end thereof for selectively allowing the supply of power to the motor;

an outlet housing integrally mounted between the bottom end of the handle and the lower portion of the housing of the power saw unit and having a rectangular configuration with a top face integrally coupled to the bottom end of the handle, a bottom face, an inboard face integrally coupled to the lower portion of the housing, an outboard face, and a pair of side faces;

an elongated power cord with a length at least 100 feet having a first end with a plug mounted thereon for releasably connecting with a power receptacle and a second end coupled to the outboard face of the outlet housing via a grommet and further in electrical communication with the motor of the power saw unit with the trigger connected therebetween;

a first outlet mounted on a first one of the side faces of the outlet housing and connected to the power cord for supplying power to a plug that is releasably inserted within the first outlet, the first outlet having a pair of parallel, vertically oriented rectangular slots and a generally circular ground aperture formed therebeneath; and a second outlet mounted on a second one of the side faces of the outlet housing and connected to the power cord for supplying power to a plug that is releasably inserted within the second outlet, the second outlet having three equally spaced arcuate slots which are positioned in a generally circular configuration each with an inwardly extending portion.

2. A tool having a power outlet, the tool comprising:

a main assembly having a housing, a motor positioned inside the housing, a handle extending from the housing, the handle having an arcuate configuration, a top end of the handle being connected to an upper portion of the housing and a lower end connected to a lower portion of the housing such that the handle remains in a generally vertical orientation, a trigger mounted on a lower face of the handle adjacent to the top end of the handle for selectively allowing the supply of power to the motor;

an outlet housing integrally mounted between the bottom end of the handle and the lower portion of the housing of the main assembly and having a top face integrally coupled to the bottom end of the handle;

an elongated power cord having a first end and a second end, a plug being mounted on the first end, the plug being for releasably connecting to a power receptacle, the second end being coupled to the outlet housing, the power cord further being in electrical communication with the motor of the main assembly, the trigger being operationally connected between the motor and the outlet housing;

a first outlet mounted on a first side face of the outlet housing, the first outlet being connected to the power cord for supplying power to a plug that is releasably inserted into the first outlet, the first outlet having a pair of parallel, vertically oriented rectangular slots and a generally circular ground aperture; and a second outlet mounted on a second side face of the outlet housing opposite the first side face, the second outlet being connected to the power cord for supplying power to a plug that is releasably inserted within the second outlet, the second outlet having three equally spaced arcuate slots which are positioned in a generally circular configuration each with an inwardly extending portion.

* * * * *